US011213961B1

(12) United States Patent
Wilson

(10) Patent No.: US 11,213,961 B1
(45) Date of Patent: Jan. 4, 2022

(54) VENTED NOSE TRIMMER

(71) Applicant: Melvin Wilson, Lenexa, KS (US)

(72) Inventor: Melvin Wilson, Lenexa, KS (US)

( * ) Notice: Subject to any disclaimer, the term of this patent is extended or adjusted under 35 U.S.C. 154(b) by 0 days.

(21) Appl. No.: 17/122,592

(22) Filed: Dec. 15, 2020

(51) Int. Cl.
*B26B 19/14* (2006.01)
*B26B 19/30* (2006.01)

(52) U.S. Cl.
CPC ..... *B26B 19/148* (2013.01); *B26B 19/30* (2013.01)

(58) Field of Classification Search
CPC ..... B26B 19/148; B26B 19/30; B26B 19/14; B26B 19/141; B26B 19/143; B26B 19/145; B26B 19/146
USPC ..... 30/29.5
See application file for complete search history.

(56) References Cited

U.S. PATENT DOCUMENTS 1,229,824 A * 6/1917 Tewelow ..... B26B 19/148 30/29.5
2,686,965 A * 8/1954 Limpan ..... B26B 19/148 30/29.5
3,284,894 A * 11/1966 Ryan ..... B26B 19/148 30/29.5
4,571,827 A * 2/1986 Lee ..... B26B 19/148 30/29.5
4,958,432 A * 9/1990 Marshall ..... B26B 19/148 30/29.5

* cited by examiner

*Primary Examiner* — Phong H Nguyen
(74) *Attorney, Agent, or Firm* — Arthur K. Shaffer; Intellectual Property Center, LLC

(57) ABSTRACT

The present invention provides a reciprocally rotatable trimmer with a plurality of vents for removing nasal hair follicles, the vented nose trimmer including a head assembly and an elongated handle, the head assembly including a plurality of vents spaced along the head assembly for selectively trimming said nasal hair follicles.

6 Claims, 4 Drawing Sheets

VENTED NOSE TRIMMER

FIELD OF THE INVENTION

The current invention relates in general to a nose hair trimmer and more specifically to a vented nose hair trimmer with a plurality of knives.

BACKGROUND OF THE INVENTION

Generally, there are two types of nose hair trimmers. Rotary nose hair trimmers and linear nose hair trimmers. A rotary nose hair trimmer uses a set of internally positioned rotary blades surrounded by a head housing the rotary blades for trimming nose hair. The head protects the nose from injury by maintaining the blades internally. A linear nose hair trimmer has movable blades, moving cooperatively with respect to a fixed blade, the blades being disposed in a head shaped for insertion into a nasal canal. Both the aforementioned types have difficulties in trimming typical nose hair in that they are very inefficient and provide limited cutting surfaces.

Typical nose trimmers use an arrangement of blades which includes two opposing blades where at least part of each of cutting surfaces are in alignment. Typically, the blades have a plurality of teeth along at least one surface aligned with each other to create a scissoring action. In some cases, the scissor action causes ripping, tearing or pinching of the hair follicle which causes pain and possible injury in the user. Therefore, there is a need to provide a nose trimmer blade arrangement which is less likely to injure the user.

In a typical nose trimmer, the length of the trimmed hair depends on the thickness of the blades. The spatial arrangement is necessary to reduce the likelihood of injury. In addition, the placement of the blades also determines the length of the trimmed hair and the smoothness of the trimming action. However, the ability to reduce the length of the trimmed hair using the traditional blade arrangement, can create a greater likelihood of injury to the user. It would thus be desirable to provide an improved nose hair trimmer which allowed for safer operation while providing for an improved trim.

There is a need for an improved trimmer device which at least addresses some of the aforementioned disadvantages.

SUMMARY OF THE INVENTION

In an embodiment of the present invention, the foregoing is addressed by providing a vented nose trimmer for selective trimming of nasal hair follicles, said vented nose trimmer comprising a head assembly supported by an elongated handle said head assembly further comprising a cylindrical body extending between a lid and a base said lid at least partially received within one end of said cylindrical body said base extending between said elongated handle and said cylindrical body a hair cutting surface; and a plurality of vents spaced along said head assembly, said vents being configured to provide access to the hair cutting surface for selectively trimming said nasal hair follicles.

In general, the nasal hair trimmer is configured for being operated within a nasal cavity for trimming nasal hair follicles by reciprocally rotating the nasal hair trimmer causing the head assembly to rotate back and forth and up and down.

DETAILED DESCRIPTION

Certain terminology will be used in the following description for convenience in reference only and will not be limiting. For example, top, bottom, front, back, right and left refer to the illustrated embodiment as oriented in the view being referred to. The words "upwardly" and "downwardly" refer to directions up or down and away from, respectively, the geometric center of the embodiment being described and designated parts thereof. Such terminology will include the words specifically mentioned, derivatives thereof and words of similar meaning.

Figure 1:
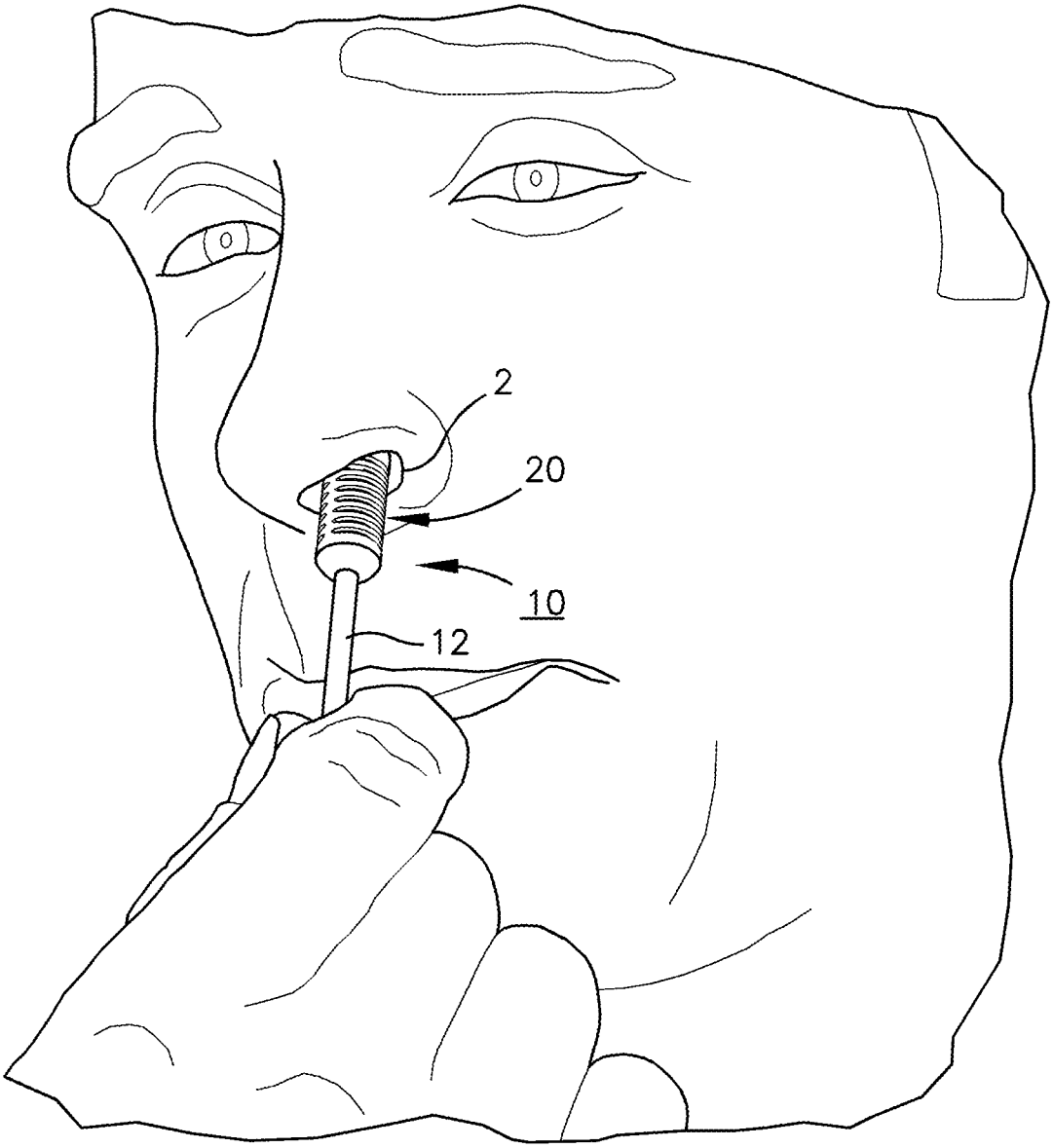
FIG. 1 is an environmental view of a nose trimmer at least partially received into a nasal cavity.

Referring to FIG. 1, an improved nose trimmer generally referred to by reference numeral 10 is illustrated as being received by an exemplary nasal cavity 2 associated with a user. The improved nose trimmer 10 generally includes an elongated handle 12 extending to a vented head assembly 20 which as depicted, is configured for receipt within a typical nasal cavity.

Figure 2:
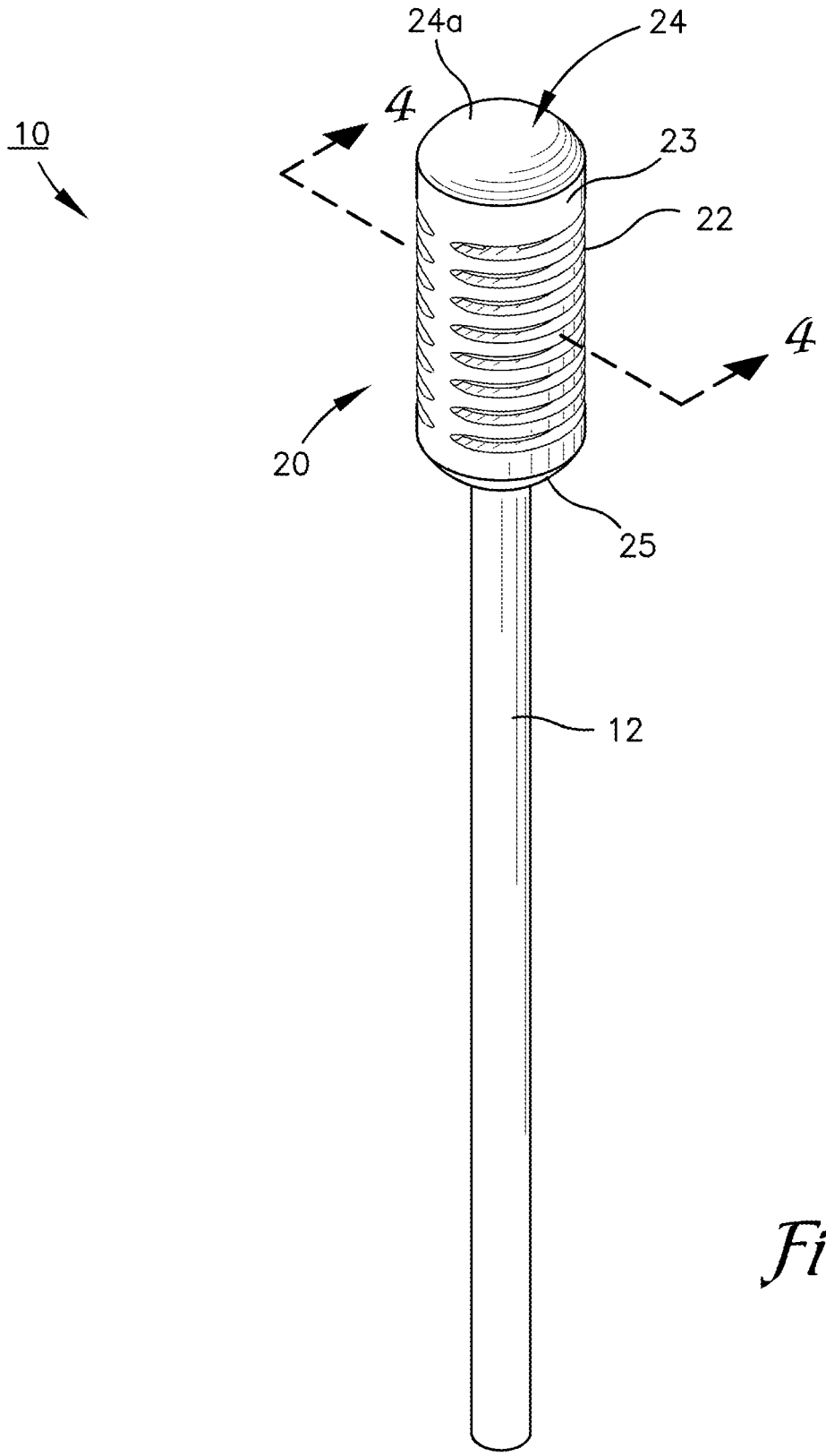
FIG. 2 is a front perspective view of an embodiment of the nose trimmer in accordance with the embodiment depicted in FIG. 1.

As further depicted in FIG. 2, the embodiment of the improved nose trimmer 10 includes the elongated handle 12 extending downwardly from the head assembly 20. The head assembly 20, generally has a cylindrical body with a cylindrical sidewall 21 extending between a lid 24 and a base 25 with a plurality of vents 22 spaced along the cylindrical sidewall 21.

Figure 3:
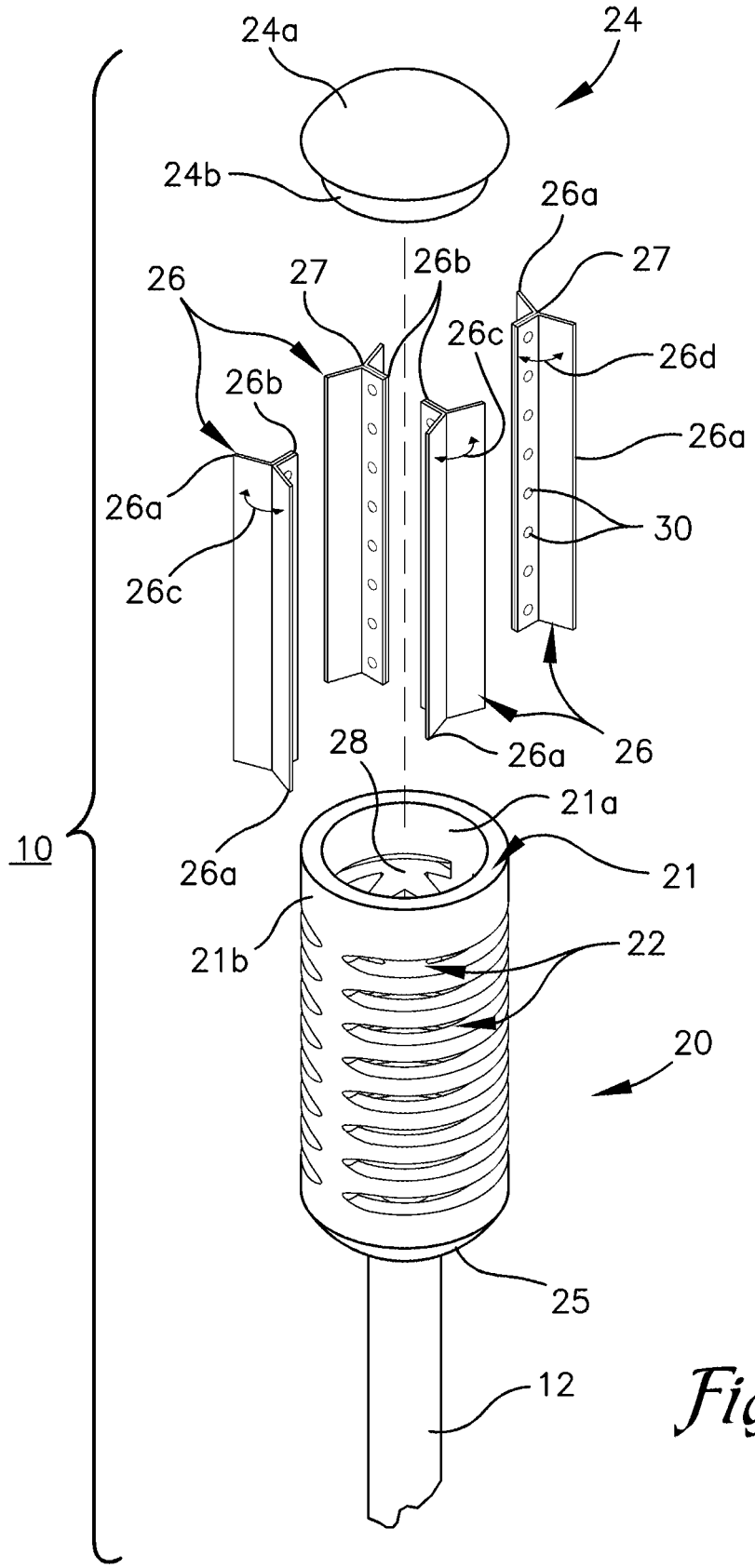
FIG. 3 is an exploded fragmented perspective view of a head assembly in accordance with the embodiment depicted in FIG. 2.
Figure 4:
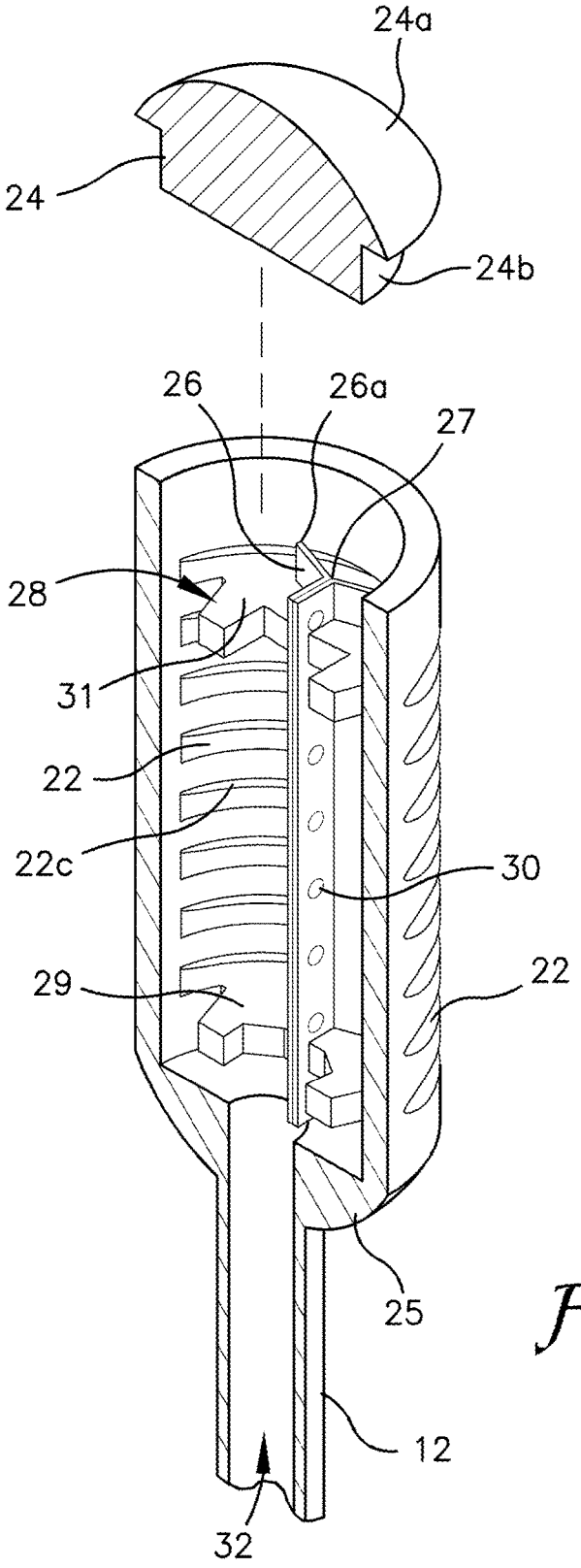
FIG. 4 is an exploded cross-sectional view taken along line 4-4 in FIG. 2 of the head assembly.

The embodiment of the lid 24 depicted in FIG. 3 is generally illustrated as being mushroom-shaped with an upper convex portion 24*a* adjoined to a lower cylindrical portion 24*b*. The outer radius associated with the lower cylindrical portion 24*b* is less than the outer radius associated with the upper convex portion 24*a*. The outer radius of the lower cylindrical portion 24*b* is generally less than the inner radius associated with the inner surface of the cylindrical body 23. As depicted in FIG. 4, the lower cylindrical portion 24*b* is generally configured for receipt within the circumferential sidewall 21 associated with the cylindrical body 23. The upper convex portion 24*a* provides a protective surface to limit injury along the nasal cavity during use. In addition, the upper convex portion 24*a* has an outer radius generally greater than the outer radius of the circumferential sidewall 21, thereby, limiting downward movement of the lid 24.

During operation, the hair cutting surface (illustrated in FIG. 4) is maintained internally within the head assembly 20. Generally, the vents 22 provide intermitting access for the internal hair cutting surface to engage any received nasal hair follicles. As depicted in FIG. 2, the vents 22 are vertically spaced along the cylindrical sidewall 21 of the head assembly 20 and provide access to the hair cutting surface for trimming the desired nasal hair follicles (not shown). Generally, the hair cutting surface is located within the head assembly 20 and faces the vents 22 for engagement with the hair follicles. The hair cutting surface generally includes the outwardly directed portion of the plural knives 26 and the inner surface of the cylindrical sidewall 21.

During operation, the improved nose trimmer 10 may be inserted into a nasal cavity (not shown). Once positioned, the nose trimmer 10 may be rotated clockwise and counter-clockwise presenting the vents 22 for receiving any nearby hair follicles (not shown). The interiorly located hair cutting surface then engages the received hair follicles for trimming as desired.

An exploded view of the head assembly 20 is depicted in FIG. 3 with the lid 24 extended from plural knives 26 which are extended outwardly from a cylindrical body 23 which includes the circumferential sidewall 21 extending between a proximate end 21*a* and a distal end 21*b* with the plurality of vents 22 spaced along the sidewall 21. The radially extended plural knives 26 in alignment with the circumferential sidewall 21 present the hair cutting surface for engagement with any hair follicles (not shown) extended through vents 22.

A cross-sectional view of the trimmer 10 is depicted in FIG. 4 with one of the knives 26 extended between an upper brace 28 and a lower brace 29. While the embodiment illustrated in FIG. 4 includes both an upper and a lower brace 28, 29 the vented hair trimmer 10 may include only one or more than two braces, also referred to herein as guides, to support the knives 26.

Generally, the upper and lower brace 28, 29, circumscribe a central channel 32 and are configured for receiving and extending the plural knives 26 in alignment with the circumferential sidewall 21. The central channel 32 extends from the elongated handle 12, through the base 25 and into the cylindrical body 23. In general, the upper and lower brace 28, 29 position at least one of the rays associated with the knives 26 along the central channel 32. The embodiment of the upper and lower brace 28, 29 depicted in FIG. 5, for example, guide the knives 26 as they extend radially from the central channel 32 towards an outer ring 33. In addition to positioning the knives 26 along the central channel 32, the upper and lower braces 28, 29 maintain the knives 26 near the circumferential sidewall 21 during reciprocal operation.

As illustrated the upper and lower brace 28, 29 have an outer dimension for extension of the outer ring 33 at least partially through one of the vents 22 and for placement of one of the cutting surfaces 26*a* along the inner surface of the circumferential sidewall 21. Optionally, the embodiment of the upper and lower brace 28, 29 may be configured for at least partial receipt by a pair of oppositely spaced vents 22, supporting and spacing the braces 28, 29 during use.

Figure 5:
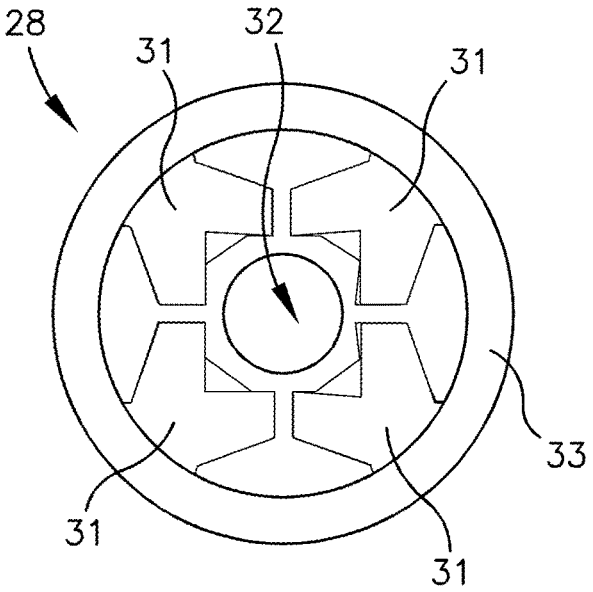
FIG. 5 is a top plan view of a guide in accordance with the embodiment of head assembly of FIG. 3.

An embodiment of the head assembly 20 includes the upper brace 28 and lower brace 29. An embodiment of one of the braces 28, 29 is illustrated in FIGS. 4-5. As illustrated, exemplary brace 28 include four Y-projections 31 which extends from the circumferential sidewall 21 towards the central channel 32. The central channel 32 generally extends along the central axis from the lid 24, through the vented head assembly 20 to the handle 12.

The embodiment of the knives 26 illustrated in FIGS. 3-4 illustrates a star shape with three rays radiating outward from a node 27. As depicted, the rays associated with each of knives 26 includes a pair of cutting edges 26*a* extending angularly from a tang 26*b*. An embodiment of the tang 26*b* includes a plurality of perforations 30.

The pair of cutting edges 26*a* extend from the node 27 in generally opposite directions for abutting the inner circumferential sidewall 21. The tang 26*b* extends from each of the cutting edges 26*a* in an opposite direction from the node 27. As depicted, each cutting edge 26*a* extends angularly from the tang 26*b*. The angular orientation of the pair of cutting edges 26*a* and the tang 26*b* presents a generally Y-shaped knife 26 with a major angle 26*c* surrounded by a pair of inferior angles 26*d*. The major angle 26*c* is presented between the pair of cutting edges 26*a*, opposite the tang 26*b*. The major angle 26*c* is generally as much as or greater than the inferior angles 26*d*. The inferior angle 26*d* is generally located between each cutting edge 26*a* and the tang 26*b* and adjacent to the major angle 26*c*. As depicted, the inferior angles 26*d* between each cutting edge 26*a* and the tang 26*b* are generally symmetrical, but may vary as desired.

As illustrated, the perforated tang 26*b* extends from the cutting edges 26*a* towards the central channel 32 during receipt between a pair of adjacent Y-projections 31. In receipt by the upper and lower braces 28, 29, the knives 26 are allowed to reciprocate laterally and longitudinally as the trimmer 10 is manually operated for trimming any nearby hair follicles.

In operation, the upper and lower braces 28, 29 receive and position the knives 26 during reciprocal operation, from any received hair follicles for trimming. Generally, the alignment and positioning of the plural knives 26 by the guide 28 form a cutting assembly, also referred to as the hair shaping assembly. The embodiment of the vents 22, depicted in FIG. 2, include arcuate ends 22*a* separated by an elongated channel 22*b* which is configured for the insertion of hair follicles through the elongated channel 22*b* and the arcuate ends 22*a* allow for receipt without inadvertently catching, gripping or ripping the follicles. Optionally, as depicted in FIG. 4, the vents 22 may include an arcuate top surface 22*c*.

It should be understood that while certain forms of this invention have been illustrated and described, it is not limited thereto except insofar as such limitations are included in the following claims.

What is claimed and desired to be secured by Letters Patent:

1. A vented nose trimmer for selective trimming of nasal hair follicles, said vented nose trimmer comprising:

a head assembly supported by an elongated handle;

said head assembly further comprising a cylindrical body extending between a lid and a base, and defining an internal hair cutting area;

said lid at least partially received within one end of said cylindrical body;

said base extending between said elongated handle and said cylindrical body;

a plurality of vents spaced along said head assembly, said vents being configured to provide access to the internal hair cutting for selectively trimming said nasal hair follicles; and an internal cutting assembly comprising a pair of spaced apart guides in receipt of a plurality of knives;

wherein each knife is star-shaped with a plurality of rays extending from a node and is received between the pair of spaced apart guides; and wherein said guide comprises a plurality of Y-shaped projections extending from one of the plurality of vents into the internal hair cutting area.

2. The vented nose trimmer of claim 1, wherein each knife includes a first cutting edge separated from a second cutting edge by a major angle.

3. The vented nose trimmer of claim 2, wherein each knife further comprising a tang extending outwardly from said first and said second cutting edges at the node.

4. The vented nose trimmer of claim 3, wherein at said tang include at least one perforation.

5. The vented nose trimmer of claim 1, wherein said lid further comprises a convex portion adjoined to a cylindrical portion, wherein said convex portion extends radially from said cylindrical portion for abutting said cylindrical body.

6. The vented nose trimmer of claim 1, wherein at least one of said vents includes a pair of arcuate ends separated by an elongated channel.

* * * * *